US005903798A

United States Patent [19]

Yokogawa et al.

[11] Patent Number: 5,903,798

[45] Date of Patent: May 11, 1999

[54] IMAGE RECORDING APPARATUS HAVING MEANS FOR APPLYING AN OPTIMUM VOLTAGE TO A TRANSFER ROLLER

[75] Inventors: Tadahiro Yokogawa, Uji; Takahiro Sasai, Kyoto, both of Japan

[73] Assignee: Murata Kikai Kabushiki Kaisha, Kyoto, Japan

[21] Appl. No.: 08/995,557

[22] Filed: Dec. 22, 1997

[30] Foreign Application Priority Data

Dec. 27, 1996 [JP] Japan ..... 8-350620

[51] Int. Cl.[6] ..... G03G 15/16

[52] U.S. Cl. ..... 399/66; 399/44; 399/314; 430/126

[58] Field of Search ..... 399/66, 313, 314, 399/297, 44; 430/126; 361/225

[56] References Cited

U.S. PATENT DOCUMENTS 5,621,509 4/1997 Karashima et al. ..... 399/66 X
5,649,265 7/1997 Tabuchi ..... 399/66 X
5,682,575 10/1997 Komori ..... 399/66
5,717,980 2/1998 Oka et al. ..... 399/66
5,768,653 6/1998 Fare ..... 399/66 X

*Primary Examiner*—Arthur T. Grimley
*Assistant Examiner*—Sophia S. Chen
*Attorney, Agent, or Firm*—Armstrong, Westerman, Hattori, McLeland & Naughton

[57] ABSTRACT

An image recording device for recording an image on a recording sheet including a transfer unit having a transfer roller and photosensitive body. The recording sheet is nipped between the transfer roller and photosensitive body when the image is recorded on the recording sheet. A first resistance value of the transfer unit of when no recording sheet is nipped between the transfer roller and photosensitive body is measured. Then, a second resistance value of the transfer unit of during recording sheet nipping is determined based on the first resistance value. A voltage adjusting mechanism determines a voltage to be applied to the transfer unit based on the second resistance value. A voltage generator generates the determined application voltage and applies it to the transfer roller such that a toner image on the photosensitive body is transferred onto the recording sheet.

12 Claims, 4 Drawing Sheets

IMAGE RECORDING APPARATUS HAVING MEANS FOR APPLYING AN OPTIMUM VOLTAGE TO A TRANSFER ROLLER

BACKGROUND OF THE INVENTION

1. Field of the Invention

The present invention generally relates to an image recording device and, more particularly, to an electrophotographic image recording device including a transfer unit having a transfer roller and opposed photosensitive body such that a sheet of paper (recording paper) is nipped between the transfer roller and photosensitive body and a toner image on the photosensitive body is transferred onto the recording paper by the transfer roller upon application of electricity to the transfer roller.

2. Description of the Related Art

Generally, electrophotographic image recording devices include an electric charger for uniformly charging a surface of a photosensitive drum, an exposing unit for illuminating the photosensitive drum surface to form an electrostatic latent image, a developing unit for adhering a toner on the electrostatic latent image to form a toner image and a transfer unit for transferring the toner image onto the recording sheet. Conventional transfer units are designed as a kind of corona discharger and corona discharge from the transfer unit applies a high voltage to a transfer roller located to oppose the photosensitive drum when the toner image is transferred. A voltage difference between the photosensitive drum and transfer unit causes the toner image on the photosensitive drum to transfer to the recording sheet.

Because the corona discharge accompanies generation of ozone, image recording devices which generate less ozone are desired in view of environmental conservation. A toner image transfer technique which does not depend upon the corona discharge is ideal. In order to meet such a need, there is a proposal which constructs a transfer unit using a roller made from an electrically conductive urethane foam or the like and a prescribed high voltage is applied to the transfer roller to establish a potential difference between the photosensitive drum and transfer roller which are opposed to each other over the recording sheet interposed therebetween.

However, the transfer roller made from urethane foam changes its electric resistance with environmental conditions such as temperature and humidity. Therefore, even if a predetermined voltage which has been determined beforehand under a particular condition is applied to the transfer roller such that the transfer roller would have a desired voltage (i.e., an optimum voltage for transferring of the toner image), the value of an actually optimum voltage may have already changed and may not be the same as the predetermined voltage due to change of the environmental conditions. If the transfer roller is not set to the optimum voltage during the transfer operation, the toner image will not sufficiently adhere onto the recording sheet, which degrades quality of image after transfer.

Another conventional image recording device is disclosed in Japanese Patent Application, Laid-Open Publication No. 8-123222. This image recording device adjusts the application voltage depending upon various conditions, but the resistance of the transfer roller and environmental temperature are not among these conditions.

Still another conventional image recording device is disclosed in Japanese Patent Application, Laid-Open Publication No. 4-275583. This image recording device determines a voltage Vt' to be applied to a transfer member by the equation of $Vt'=aVt+b$ where Vt is the voltage of the transfer member of when no image transfer operation is conducted, and "a" and "b" are compensation coefficients. The voltage Vt is compared with a reference value and the coefficients "a" and "b" are changed based on a difference between the voltage Vt and the reference value such that the application voltage Vt' is adjusted according to changing conditions.

SUMMARY OF THE INVENTION

It is an object of the present invention to provide an image recording apparatus which can set the transfer roller to have a voltage optimum for toner image transfer so as to obtain a high quality transferred image.

Another object of the present invention is to provide an image recording apparatus which can first acquire information needed for image transfer under a particular condition, modify or compensate the information according to an actual condition and determine an optimum voltage to be applied to the transfer roller during the toner image transfer using the amended information.

According to a first aspect of the present invention, there is provided an apparatus for recording an image on a recording sheet including: a transfer unit having a transfer roller and opposed photosensitive body such that the recording sheet is nipped between the transfer roller and photosensitive body; and means for applying a voltage to the transfer roller such that a toner image on the photosensitive body is transferred onto the recording sheet upon application of the voltage to the transfer roller, wherein the image recording apparatus further includes first determination means for determining a first electrical resistance value of the transfer unit when no recording sheet is nipped between the transfer roller and photosensitive body, a second determination means for determining a second electrical resistance value of the transfer unit during recording sheet nipping based on the first electrical resistance value; and voltage adjusting means for optimizing a voltage to be applied to the transfer unit based on the second electrical resistance value.

This improvement to image recording apparatuses stands on the concept of adjusting the voltage to be applied to the transfer roller based on the electrical resistance value of the transfer unit. In order to optimize the voltage app lied to the transfer roller, it is important to accurately know the electrical resistance value of the transfer unit while the recording sheet is nipped between the transfer roller and photosensitive body. However, image recording apparatuses cannot directly measure an electrical resistance value of the transfer unit while the transfer roller and the photosensitive body nip the recording sheet due to various conditions and constraints which the actual apparatuses have. Because of this, the electrical resistance value of the transfer unit while no recording sheet is nipped, which is easy to measure, may be used as the electrical resistance value of the transfer unit during paper nipping. However, if there is a great discrepancy between the electrical resistance value during no paper nipping and that during paper nipping which may not be neglected, the quality of the transferred image is deteriorated as long as the optimum voltage to be applied to the transfer roller is determined based on an assumption that the electrical resistance value of the transfer unit during no paper nipping is substantially equal to that during paper nipping. The image recording apparatus of the present invention, on the contrary, amends the value of the transfer unit resistance value during no paper nipping in determining the optimum application voltage. Specifically, the second determination means uses the resistance value the transfer unit of during no paper nipping to acquire another value, and the voltage adjusting means determines the optimum voltage based on this "another value". The resistance value during no paper nipping is easy to measure. A certain correction or compensation is then applied to the resistance value during no paper nipping to determine the resistance value during paper nipping. The resistance value during no paper nipping is indirectly used to determine the optimum voltage to be applied to the transfer roller in this invention. The application voltage to the transfer roller is controlled in this manner to improve the quality of the transferred image.

The second determination means may determine the second electrical resistance value (i.e., an assumed resistance value of during paper nipping) using a characteristic chart or map which establishes relationship between the first and second electrical resistance values. The first-and-second resistance map is prepared beforehand. This map may be prepared by experiments. The map provides the relationship between the first and second resistance values in the most accurate form. Therefore, an optimum transfer roller voltage is determined reliably. It should be noted that the map may be updated by further experiments. It should also be noted that the process unit and the transfer unit are equivalent to each other.

BRIEF DESCRIPTION OF THE ACCOMPANYING DRAWINGS

FIG. 2 illustrates an enlarged sectional view of major parts of the image recording device shown in FIG. 1 together with a schematic electrical configuration of associated parts;

DETAILED DESCRIPTION OF THE PREFERRED EMBODIMENTS

Hereafter, a preferred embodiment of the present invention will be described with reference to the accompanying drawings. The illustrated embodiments are suitable for, for example, facsimile machines and copiers.

Figure 1:
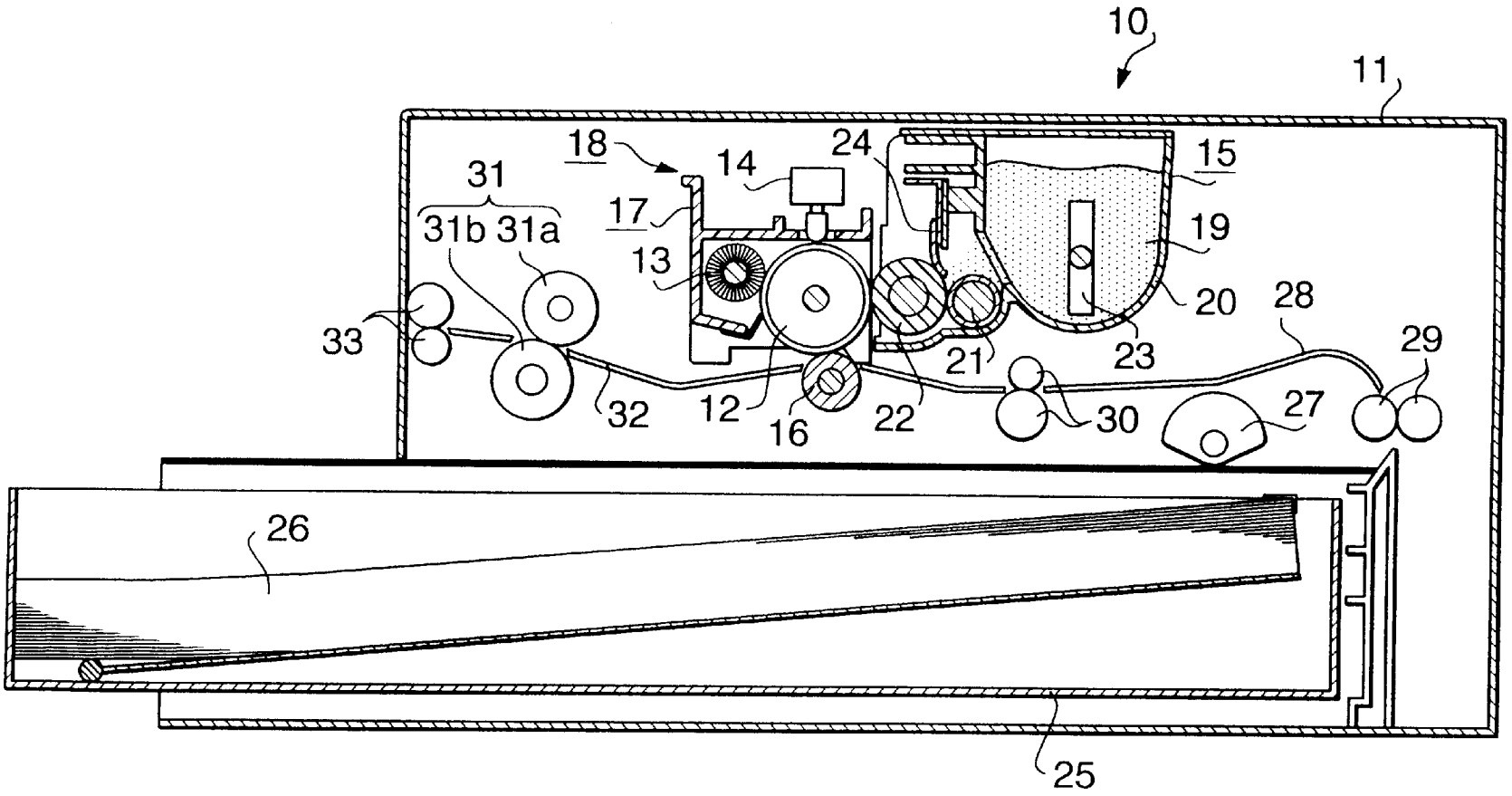
FIG. 1 illustrates a sectional view of an image recording device according to the present invention.

FIG. 1, illustrates a schematic structure of an image recording device 10 of the present invention. The image record ing device 10 includes a housing 11, a drum unit 17 and a process unit 18. The drum unit 17 and process unit 18 are located in the housing 11. The process unit 18 is a unit for form ing an image and transferring it onto a recording sheet and includes a drum unit 17, exposing unit 14, developing unit 15 and transfer roller 16. The photosensitive drum 12 is a photosensitive body having a photoconductive film on its surface. The photosensitive drum 12 is grounded. The electrical charger 13, exposing unit 14, developing unit 15 and transfer roller 16 are arranged in turn around the photosensitive drum 12 in a clockwise direction. This clockwise direction is a rotation direction of the photosensitive drum 12 and is indicated by the arrow "A" in FIG. 2. In actuality, the photosensitive drum 12 and electrical charger 13 may be provided as a single unit called drum unit 17. The photosensitive drum 12 is rotated by a drive (not shown) placed outside the drum unit 17. Although not illustrated, a top portion of the housing 11 is openable and closable by means of, for instance, a flap cover. W hen the top cover of the housing 11 is opened, the drum unit 17 and developing unit 15 can independently be taken out of the housing 11.

The electrical charger 13 is a brush-roller type charger which has a shaft and a number of conductive wires or hairs on a shaft surface. A predetermined bias voltage is applied to the electrical charger 13. The electrical charger 13 which has been charged upon application of the bias voltage uniformly charges the outer surface of the photosensitive drum 12 to about −750V while it is rotating.

The exposing unit 14 includes a number of LEDs and illuminates the surface of the photosensitive drum 12 based on input image information. Upon this irradiation, those portions of the photosensitive drum surface which receive the light have a potential of about −50V. In this manner, the irradiated portions (which correspond to black image information) and non-irradiated portions (which correspond to white image information) of the photosensitive drum surface have different voltages. As a result, an electrostatic latent image corresponding to the image information is formed on the surface of the photosensitive drum 12.

The developing unit 15 includes a toner casing 20 for storing a toner 19, a feed roller 21 located at a lower position in the toner casing 20 and a developing roller 22 located at a lower opening of the toner casing 20 between the feed roller 21 and photosensitive drum 12. The feed roller 21 and developing roller 22 are rotated counterclockwise by a drive (not shown) placed outside the developing unit 15. Their rotating directions are indicated by the arrows B and C in FIG. 2, respectively.

Referring now to FIG. 2, depicted is a schematic electrical configuration of a voltage adjusting means for optimizing a voltage to be applied to the transfer roller 16 together with the process unit 18 in a larger scale. The feed roller 21 includes a shaft 21*a* made from metal (e.g., stainless steel) and a conductive foam (e.g., urethane foam) 21*b* attached over the shaft surface. A prescribed bias voltage is given to the feed roller 21. This bias voltage varies from −600V to −700V and is preferably about −650V. The developing roller 22 includes a metallic shaft 22*a* made from, for instance, stainless steel and a conductive rubber 22*b* attached over the shaft 22*a*. Preferably, the conductive rubber 22*b* is a butadien-acrylonitrile rubber (NBR), silicon rubber or urethane rubber. The developing roller 22 contacts the feed roller 21 and photosensitive drum 12. A prescribed bias voltage is applied to the developing roller 22. This bias voltage varies from −300V to −400V and is preferably about −350V.

An agitator element or stirrer 23 is placed in the toner casing 20. The agitator element 23 is rotated by a drive (not shown) to agitate the toner 19 in the casing 20. A limitation or regulating blade 24 is provided at the opening of the toner casing 20 such that the blade 24 resiliently contacts the outer surface of the developing roller 22. The limitation blade 24 serves to make the thickness of the toner adhering on the developing roller surface uniform. The limitation blade 24 is a resilient element made from a conductive rubber or metal and is preferably an urethane rubber sheet or stainless sheet member. A prescribed bias voltage is applied to the limitation blade 24. The bias voltage is between −600V and is −700V and preferably about −650V.

When the feed roller 21 and developing roller 22 are rotated, they are infrictional contact. While the rollers 21 and 22 are rotating, the bias volt ages are applied to the rollers 21 and 22, respectively. As a result, the toner 19 in the vicinity of these rollers 21 and 22 is electrically charged. Up on rotation of the feed roller 21, the toner in the pores or cavities of the foam 21*b* of the feed roller 21 is transferred to the developing roller 22. At a press contact area between the feed roller 21 and developing roller 22, the toner moves to the developing roller 22 from the feed roller 21 based on the voltage difference between the rollers 21 and 22 and adheres onto the surface of the developing roller 22. The toner adhering onto the developing roller surface is transmitted to the photosensitive drum 12 via the limitation blade 24 upon rotation of the developing roller 22. The toner on the developing roller 22 has a uniform thickness when it moves through the limitation blade 24. This is one of important roles of the limitation blade 24.

Since the toner on the developing roller 22 is charged to about −650V, the toner is absorbed or attracted by the electrostatic latent image based on the voltage difference between the toner and electrostatic latent image on the photosensitive drum 12 when the toner on the developing roller 22 contacts the photosensitive drum 12. Consequently, a toner image is formed on the photosensitive drum 12.

As illustrated in FIG. 1, a recording sheet cassette 25 is detachably fitted in a lower portion of the main housing 11. A number of recording sheets 26 are placed in the cassette 25 in a stacked condition. As a pick-up roller 27 rotates in the housing 11, the recording sheets 26 are taken out one-by-one from the paper cassette 25. Then, the recording sheet 26 is carried to a gap between the photosensitive drum 12 and transfer roller 16 by a pair of transmission rollers 29 and a pair of transmission rollers 30 along a paper guide 28.

The transfer roller 16 is located such that it contacts the surface of the photosensitive drum 12 on the recording sheet path defined by the paper guide 28. The transfer roller 16 is rotated by an actuation mechanism (not shown). As best illustrated in FIG. 2, the transfer roller 16 includes a metallic (e. g., stainless steel) shaft 16*a* and a conductive foam 16*b* attached on the surface of the shaft 16*a*. The foam 16*b* may be a urethane foam. The transfer roller 16 has a predetermined bias voltage applied to it from a high voltage generator 34 through the shaft 16*a*.

The recording sheet 26 is squeezed into the gap between the photosensitive drum 12 and transfer roller 16 and nipped by the drum 12 and roller 16. Specifically, the transfer roller 16 forces the recording sheet 26 to firmly contact the surface of the photosensitive drum 12. In this situation, the back side of the recording sheet 26 is in contact with the transfer roller 16 to which the voltage is applied. Therefore, the potential difference between the photosensitive drum 12 and transfer roller 16 causes the toner image on the photosensitive drum 12 to transfer of the recording sheet 26. After transferring of the toner image, the recording sheet 26 is moved to a fixing unit 31 (FIG. 1) upon synchronous rotation of the photosensitive drum 12 and transfer roller 16.

Referring to FIG. 1, the fixing unit 31 is placed after the photosensitive drum 12 in the main housing 11 and includes a heating roller 31*a* and a presser roller 31*b* in press-contact with the heating roller 31*a*. These rollers 31*a* and 31*b* are provided on opposite sides of the recording sheet path. When the recording sheet 26 is moved to a gap between the heating roller 31*a* and presser roller 31*b* along the paper guide 32, a resin component of the toner is fused and fixed onto the recording sheet 26. Consequently, the toner image is ultimately fixed on the recording sheet 26 as a permanent image. After that, the recording sheet 26 is discharged out of the housing 11 by a pair of exit rollers 33.

In the meantime, part of the photosensitive drum surface after the toner image transfer is charged to a positive voltage by the transfer roller 16, and then moved to a position facing the electrical charger 13 upon rotation of the photosensitive drum 12. Accordingly, that part of the photosensitive drum surface is uniformly charged to about −750V again by the electrical charger 13. It should be noted that a certain amount of toner remains on the surface of the photosensitive drum 12 after the image transfer. In other words, all the toner is not transferred to the recording paper. This remaining toner is uniformly spread or dispersed over the surface of the photosensitive drum 12 and charged to about −750V by the brush-shaped electrical charger 13 when it is moved to a position facing the electric charger 13 upon rotation of the photosensitive drum 12. The dispersed toner does not affect formation of a next electrostatic latent image performed by the exposing unit 14. Eventually, the dispersed remaining toner is attracted by the developing roller 22 based on the voltage difference between itself and the developing roller 22 when it is moved to a position facing the developing roller 22 of the developing unit 15 upon rotation of the photosensitive drum 12. As a result, the toner is returned to the toner casing 20 and used in a next image formation process. In sum, the remaining toner dispersed by the electrical charger 13 is recovered by the developing unit 15 and not wasted. Thus, the developing unit 15 has not only a developing function but also a cleaning function or toner recovery function. It is therefore possible to prevent the photosensitive drum surface from being stained by the toner and completely use the toner for developing.

Referring back to FIG. 2, an electric configuration of an application voltage adjusting mechanism adapted to set an application voltage optimum to the toner image transfer by applying a desired bias voltage to the transfer roller 16 will be described. This application voltage adjusting mechanism includes a high voltage generator 34, fixed electrical resistance 35, voltage detector 36, two A/D converters 37, 41, control 38, temperature sensor 39 and amplifier 40.

The high voltage generator 34 is an electrical circuit for generating a bias voltage Vin to be applied to the transfer roller of test voltage Vtest and includes a reference power source, first transformer for converting a voltage of the reference power source to a predetermined value, second transformer for further raising this voltage, etc. The second transformer may include a DC/DC converter.

Between the high voltage generator 34 and transfer roller 16, provided in series is the constant electrical resistance 35 having a value Rf. Ends of this resistance 35 are connected with a pair of input terminals of the voltage detector 36 respectively. The voltage detector 36 may include a differential amplifier and resistances, and be designed to output a voltage signal corresponding to a voltage difference Vo between the ends of the constant resistance 35 upon receiving input voltages from the input terminals of the voltage detector 36. The resulting voltage signal is converted to a digital signal by the first A/D converter 37 and input to the control 38.

The temperature sensor 39 is located in the vicinity of the transfer roller 16. The temperature sensor 39 detects a temperature near the transfer roller 36 and outputs a detect ion signal corresponding to the detected temperature. The detection signal is then amplified by the amplifier 40, converted to a digital signal by the second A/D converter 41 and input to the control 38.

The control 38 is provided for controlling overall operations of the image recording device 10 and includes CPU, memory 38*a* (ROM and RAM) and interface. The memory 38*a* stores various programs needed for determining an optimum voltage to be applied to the transfer roller 16 and controlling the high voltage generator 34 according to the determined optimum voltage as well as various data including characteristic charts and maps needed for controlling. The control 38 receives the digital signals from the two A/D converters 37, 41 and a start signal SG1 for initiating the image recording process from outside. Based on these signals, the control 38 produces and outputs a control signal SG2 for controlling the voltage to be generated by the high voltage generator 34. It should be noted that the control 38 is a control means and the high voltage generator 34 and constant resistance 35 constitute the adjusting means in this particular embodiment.

Procedures for determining and controlling an optimum application voltage to the transfer roller:

Now, procedures for determining an optimum voltage applied to the transfer roller 16 using the application voltage adjusting mechanism will be described with reference to the flowchart shown in FIG. 3, an equivalent circuit diagram shown in FIG. 4 and two characteristic charts shown in FIGS. 5 and 6.

Figure 3:
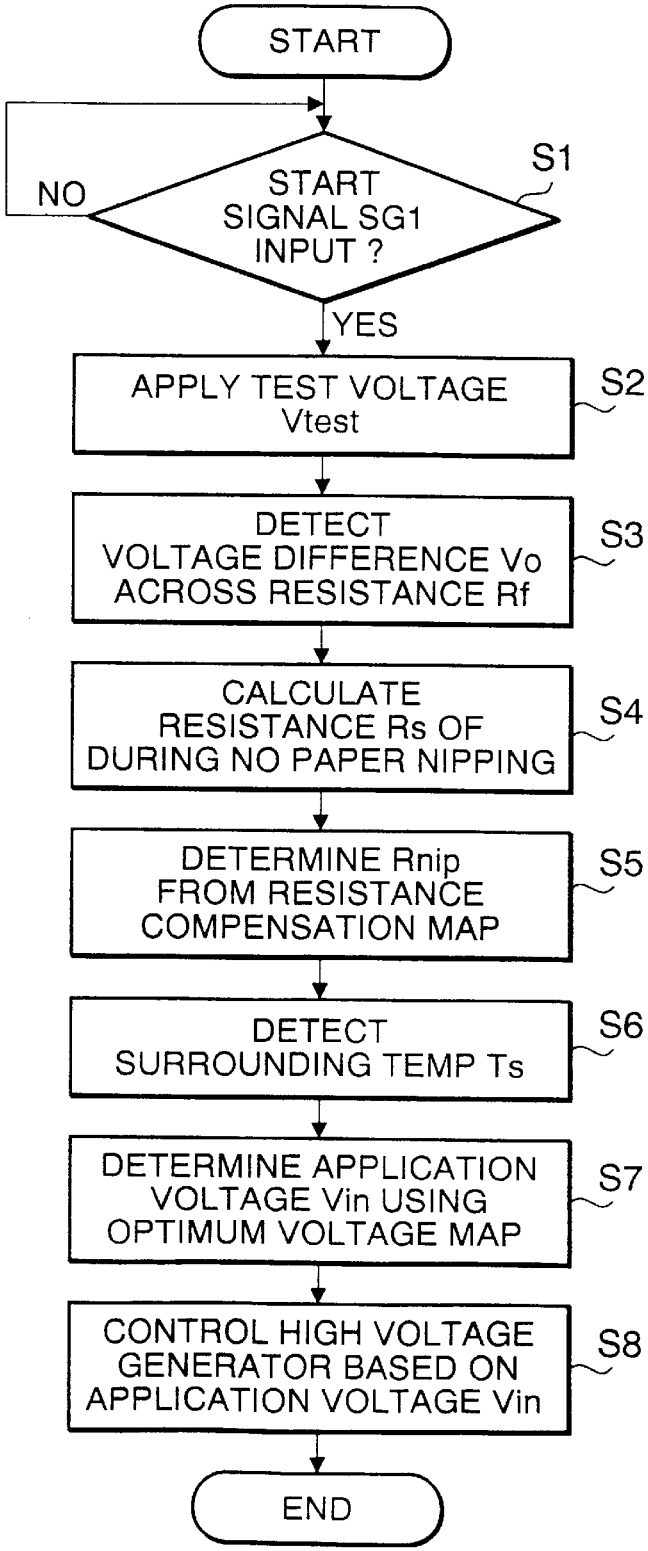
FIG. 3 illustrates a flowchart for determining an optimum voltage to be applied to a transfer roller of the recording device shown in FIG. 1 and for controlling a high voltage generator for application of the optimum voltage.
Figure 3:
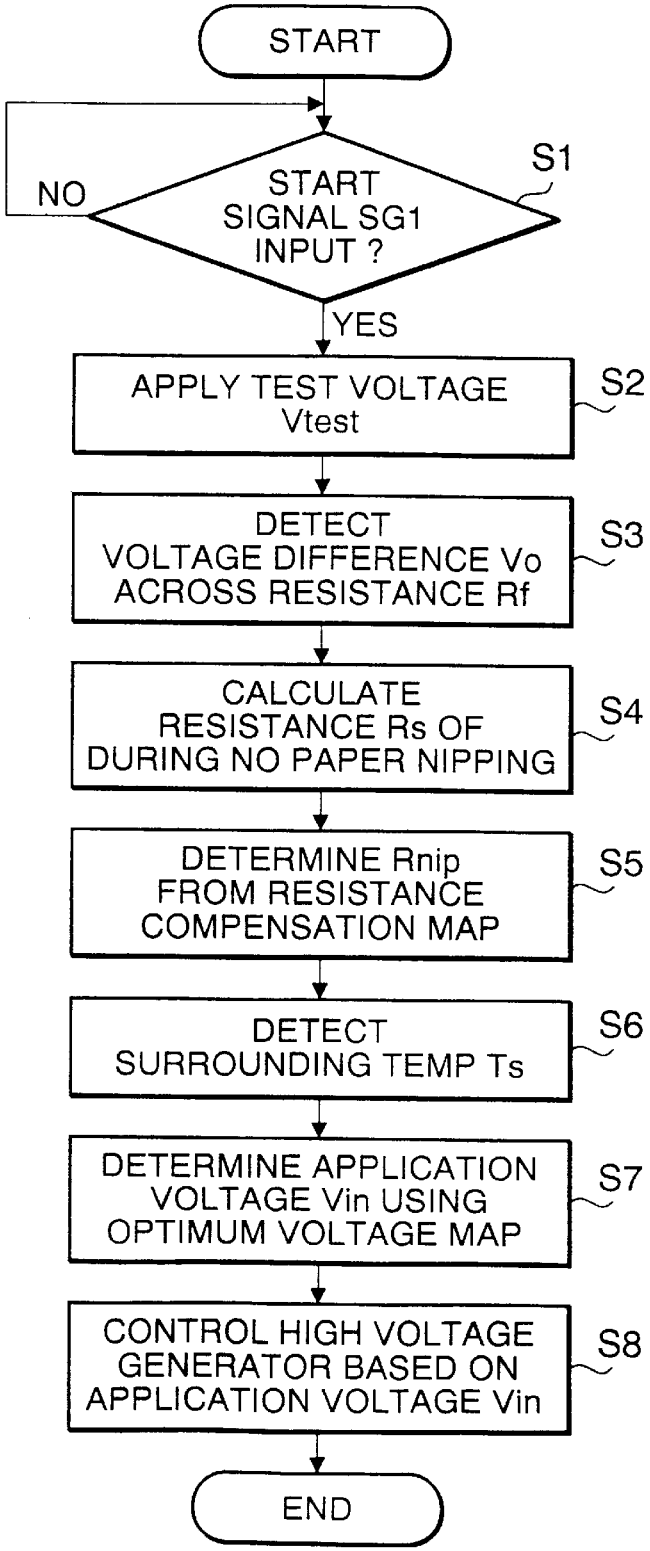

Referring to FIG. 3, the control 38 waits for a start command signal SG1 from an outside apparatus at step S1. In other words, the control 38 is in a standby condition until such a command is input to the control 38. When the start signal SGI is input, the control 38 determines an optimum voltage to be applied to the transfer roller 16 prior to initiation of the image recording process. The control 38 also controls the high voltage generator 34 in such a manner that the previously determine voltage be applied to the transfer roller 16 during the image recording operation. For this end, the control 38 outputs a first control signal SG2 to the high voltage generator 34 such that the high voltage generator 34 generate a prescribed test voltage Vtest before the recording sheet 26 is nipped between the photosensitive drum 12 and transfer roller 16. The test voltage Vtest is applied to the transfer roller 16 via the constant electric resistance 35 at step S2. Then, the control 38 detects the voltage difference Vo between the two ends of the constant electrical resistance 35 based on the voltage signal supplied from the voltage detector 36. The control 38 also acquires an overall resistance value of the process unit 18 of during no paper nipping based on the voltage difference Vo. The resistance value of the process unit 18 is a collective resistance of the transfer unit. This will be described more in detail below.

Before the image recording process is not started and no recording sheet 26 is nipped between the photosensitive drum 12 and transfer roller 16, the transfer roller 16 is in direct contact with the photosensitive drum 12. On the other hand, the photosensitive drum 12 directly contacts the electrical charger 13 and developing roller 22 and indirectly contacts the feed roller 21 and limitation blade 24 via the developing roller 22. Therefore, it is possible to consider that the above parts 12, 13, 16 21, 22 and 24 of the process unit 18 form a single collective resistance. This electrical resistance value of the process unit 18, constant electrical resistance 35 and high voltage generator 34 can be depicted in an equivalent circuit shown in FIG. 4. It should be noted that the transfer roller 16 made from, for example, urethane foam has an electrical resistance which varies with temperature, humidity and the like so that the electric resistance value of the process unit 18 can be considered as a variable resistance.

Here, the variable electrical resistance value of the process unit 18 is represented by Rs and a voltage drop by this variable resistance Rs is represented by Vs. Then, the following equation (1) is obtained when the prescribed test voltage Vtest is applied from the high voltage generator 34.

$$Vtest=Vo+Vs \tag{1}$$

Figure 4:
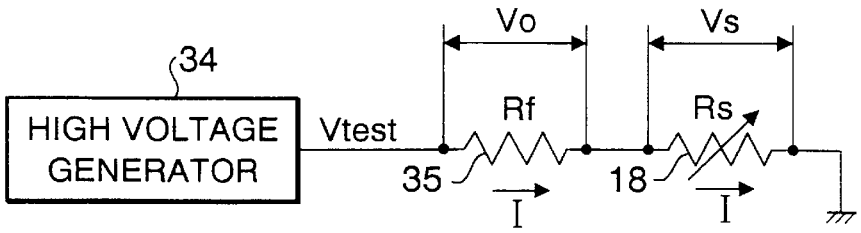
FIG. 4 illustrates an electrically equivalent circuit of a transfer unit of the image recording device shown in FIG. 1 to determine an electrical resistance value of the transfer unit during no paper nipping.

If a current flowing in the circuitry shown in FIG. 4 is I, the above equation (1) is rewritten to the following equations (2) and (3).

$$\begin{aligned} Vtest &= Vo + Vs \\ &= Vo + IRs \end{aligned} \tag{2}$$

$$\begin{aligned} Rs &= (Vtest - Vo)/I \\ &= (Vtest - Vo)Rf/Vo \\ &= (Vtest/Vo - 1)Rf \end{aligned} \tag{3}$$

Since the control 38 can determine the differential voltage Vo based on the voltage signal from the voltage detector 36 and the test voltage Vtest and constant resistance Rf are already known, the control 38 can calculate the resistance Rs using the equation (3). In this sense, the high voltage generator 34 generating the test voltage Vtest, fixed resistance 35, voltage detector 36, A/D converter 37 and control 38 cooperate and constitute a means for measuring the resistance value of the transfer unit during no paper nipping.

In this manner, the control 38 obtains the differential voltage Vo across the ends of the constant resistance 35 of when the test voltage Vtest is applied at step S3. Then, the control 38 calculates the whole resistance Rs of the process unit 18 of during no paper nipping based on the differential voltage Vo at step S4.

Next, the control 38 refers to a resistance value compensation map (FIG. 5) stored in the memory 38*a* to determine a whole resistance value Rnip of the process unit 18 of when the recording paper 26 is nipped between the photosensitive drum 12 and transfer roller 16 at step S5. The compensation map shown in FIG. 5 establishes a relationship between temperature and resistance value during no paper nipping (L1) and a relationship between temperature and resistance value of during paper nipping (L2). These temperature-resistance characteristics are prepared beforehand by experiments. Using this resistance value compensation map, the control 38 can easily determine the resistance value Rnip of during paper nipping. Specifically, an environmental temperature Te is determined from the resistance value Rs obtained at step S4 and characteristic line L1, and the resistance value Rnip of the process unit 18 is determined from the environmental temperature Te and characteristic line L2.

Prior to the image recording process, the control 3 determines a temperature Ts around the transfer roller 16 based on a detection signal from the temperature sensor 39 at step S6. The control 38 then refers to another map (FIG. 6) stored in the memory 38*a* and determines an optimum voltage Vin to be applied to the transfer roller 16 based on the resistance value Rnip of the process unit 18 and neighboring temperature Ts of the transfer roller 16 at step S7.

Figure 6:
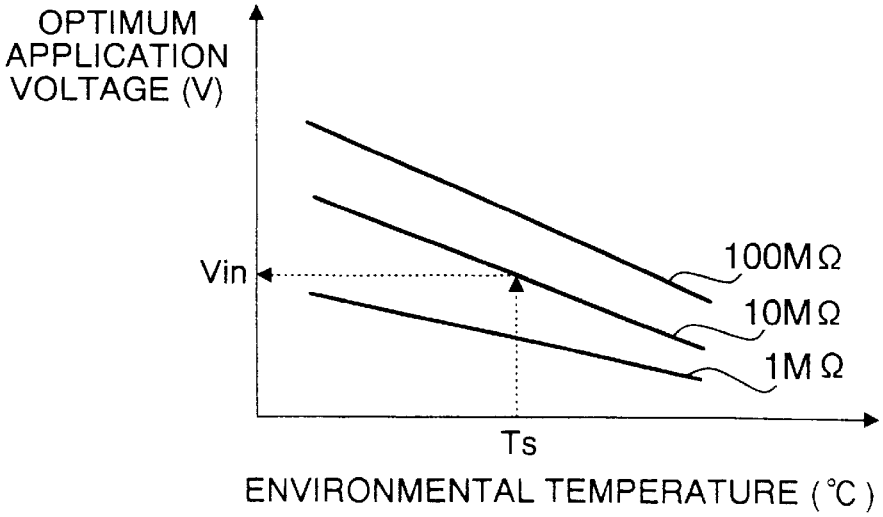
FIG. 6 is a characteristic map for determining an optimum application voltage.

The optimum application voltage map shown in FIG. 6 provides relationship between the temperature is and optimum voltage Vin using the resistance value Rnip as a parameter. In FIG. 6, the resistance value Rnip changes from 1 to 100 megohms (Mω). The resistance value Rnip can take an arbitrary value in this range in the illustrated embodiment. Th e temperature-voltage characteristic lines in the map of FIG. 6 are prepared beforehand by experiments in such a manner that the voltage Vin to be applied to the transfer roller 16 takes an optimum value in an actual image recording process. Of course, the experiments should be carried out under various conditions which the image recording device 10 would experience during an actual recording process. For instance, the control 38 determines the optimum application voltage Vin for the detected temperature Ts based on the 10-megohm characteristic ine shown in FIG. 6 if the resistance Rnip of the process unit 18 is equal or close to 10 megohms. It should be noted that the three characteristic lines shown in FIG. 6 are mere examples. How many characteristic lines should be drawn in this map would be determined arbitrarily as desired.

During the image recording operation, the control 38 outputs the control signal SG2 to the high voltage generator 34 to cause the high voltage generator 34 to produce the optimum voltage Vin determined at step S7 (step S8). Upon application of the optimum voltage Vin from the high voltage generator 34, the transfer roller 16 has a voltage optimum to transferring of the toner image. In this situation, the image formation and transfer are carried out so that the toner image on the photosensitive drum 12 is reliably transferred onto the recording sheet 26 by the transfer roller 16.

The illustrated image recording device 10 can demonstrate the following advantages:

(1) The application voltage Vin to the transfer roller 16 is determined based on the resistance value of the transfer unit including the transfer roller 16 such that the voltage of the transfer roller 16 has an optimum value for the toner image transfer to the recording sheet 26. Therefore, even if the resistance value of the transfer unit varies with the environmental conditions such as temperature, it is possible to always maintain the voltage of the transfer roller 16 to a particular value optimum to the toner image transfer. Accordingly, the toner image on the photosensitive drum 12 is securely transferred onto the recording sheet 26 under optimum conditions.

(2) In order to determine the resistance value of the transfer unit, the resistance is first actually measured in a no paper nipping state. Then, this measured value is used together with the resistance value compensation map (FIG. 5) to obtain the resistance value of the transfer unit in a paper nipping state. The optimum application voltage Vin to the transfer roller 16 is determined from the resistance value of the transfer unit in the paper nipping state. In other words, the optimum voltage Vin is determined in consideration of actual conditions (i. e., when the recording sheet 26 is nipped between the photosensitive drum 12 and transfer roller 16). Therefore, the determined optimum voltage matches the actual conditions and improves the quality of the image transferred to the recording sheet 26.

(3) The resistance value compensation map (FIG. 5) shows a relative relationship between the transfer unit resistance values a Rs in the no paper nipping state and Rnip in the paper nipping state and this map is made by experiments. Therefore, the map of FIG. 5 is a chart best illustrating characteristic correlation of these resistance values. By taking advantage of this map, determination of the best application voltage Vin to the transfer roller 16 is carried out accurately.

(4) The resistance value of the transfer unit including the transfer roller 16 changes with the environmental conditions such as temperature and humidity: particularly, the temperature is influential. Therefore, the application voltage Vin to the transfer roller 16 is determined based on not only the resistance value of the process unit 18 but also the temperature as depicted in FIG. 6. This determination manner greatly contributes to providing a better voltage value Vin.

It should be noted that the present invention is not limited to the above described embodiment but the following changes and modifications may be made within the scope of the invention.

Figure 5:
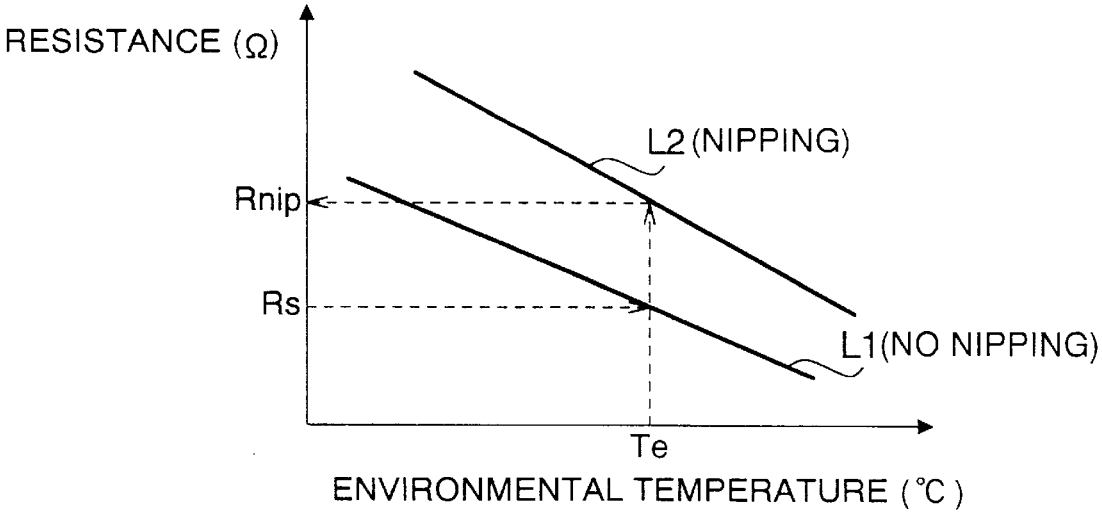
FIG. 5 illustrates an electrical resistance value compensation map for determining an electrical resistance value of the transfer unit of during paper nipping.

(i) Instead of using the resistance value compensation map of FIG. 5, a predetermined equation may be used to obtain the resistance value of the transfer unit of during paper nipping (Rnip) based on an actually measured resistance value of during no paper nipping (Rs). Such an equation is formulated to establish a relationship between the resistance values of transfer unit of during no paper nipping and paper nipping. The equation occupies a less storage area in the memory 38*a* than the map. Therefore, the control program can be designed to be more compact.

(ii) The temperature sensor 39, amplifier 40 and A/D converter 41 constitute in combination a temperature detection means for detecting the transfer roller neighboring temperature in FIG. 2. However, this temperature detection means may be dispensed with in determining the optimum application voltage Vin. Specifically, when the resistance value compensation map of FIG. 5 is referred to based on the detected resistance value Rs of during no paper nipping (step S5), the environmental temperature Te is obtained using the map of FIG. 5. This environmental temperature Te has a close correlation with the actual neighboring temperature Ts. In some cases, these temperatures are equal to each other. Therefore, by assuming that the temperature Te obtained from the resistance value compensation map be the transfer roller neighboring temperature Ts, the optimum application voltage Vin may be determined using the map of FIG. 6 based on the temperature Te. In this case, the electric configuration of the application voltage adjusting mechanism may be simplified.

As described above, the image recording device of the present invention can set the transfer roller voltage to a value optimum to the toner image transfer so that a high quality transferred image results. In particular, the actual measured resistance value of the transfer unit is appropriately corrected or modified to provide information needed to determine the transfer conditions, and the modified value is used to determine the voltage to be applied to the transfer roller during the toner image transfer. This further contributes to improvement of the ultimate image quality.

What is claimed is:

1. An image recording device for recording an image on a recording sheet, comprising:

a transfer unit having a transfer roller and opposed photosensitive body such that the recording sheet is nipped between the transfer roller and photosensitive body;

first determination means for determining a first resistance value of the transfer unit when no recording sheet is nipped between the transfer roller and photosensitive body;

second determination means for determining a second resistance value of the transfer unit of during recording sheet nipping based on the first resistance value;

third determination means for determining a voltage to be applied to the transfer unit based on the second resistance value; and means for applying the voltage to the transfer roller such that a toner image on the photosensitive body is transferred onto the recording sheet upon application of the voltage to the transfer roller;

wherein said image recording device further includes a characteristic map which establishes a relationship between the first and second resistance values and wherein the second determination means determines the second resistance value using the characteristic map.

2. An image recording device for recording an image on a recording sheet, comprising:

a transfer unit having a transfer roller and opposed photosensitive body such that the recording sheet is nipped between the transfer roller and photosensitive body;

first determination means for determining a first resistance value of the transfer unit when no recording sheet is nipped between the transfer roller and photosensitive body;

second determination means for determining a second resistance value of the transfer unit of during recording sheet nipping based on the first resistance value;

third determination means for determining a voltage to be applied to the transfer unit based on the second resistance value; and means for applying the voltage to the transfer roller such that a toner image on the photosensitive body is transferred onto the recording sheet upon application of the voltage to the transfer roller;

wherein the transfer unit has a fixed resistance (Rf) and variable resistance (Rs) coupled with the fixed resistance in series, and the first determination means includes:

means for applying a test voltage (Vtest) to the transfer unit;

means for measuring a voltage drop (Vo) across the fixed resistance (Rf);

means for measuring a current (I) flowing in the transfer unit; and means for determining the variable resistance value (Rs) using the following equation:

$$Rs=(Vtest-Vo)/I.$$

3. An image recording device for recording an image on a recording sheet, comprising:

a transfer unit having a transfer roller and opposed photosensitive body such that the recording sheet is nipped between the transfer roller and photosensitive body;

first determination means for determining a first resistance value of the transfer unit when no recording sheet is nipped between the transfer roller and photosensitive body;

second determination means for determining a second resistance value of the transfer unit of during recording sheet nipping based on the first resistance value;

third determination means for determining a voltage to be applied to the transfer unit based on the second resistance value; and means for applying the voltage to the transfer roller such that a toner image on the photosensitive body is transferred onto the recording sheet upon application of the voltage to the transfer roller;

wherein the transfer unit has a fixed resistance (Rf) and variable resistance (Rs) coupled with the fixed resistance in series, and the first determination means includes:

means for applying a test voltage (Vtest) to the transfer unit;

means for measuring a voltage drop (Vo) across the fixed resistance (Rf); and means for determining the variable resistance value (Rs) using the following equation:

$$Rs=(Vtest-Vo)Rf/Vo.$$

4. An image recording device for recording an image on a recording sheet, comprising:

a transfer unit having a transfer roller and opposed photosensitive body such that the recording sheet is nipped between the transfer roller and photosensitive body, first determination means for determining a first resistance value of the transfer unit when no recording sheet is nipped between the transfer roller and photosensitive body;

second determination means for determining a second resistance value of the transfer unit of during recording sheet nipping based on the first resistance value;

third determination means for determining a voltage to be applied to the transfer unit based on the second resistance value; and means for applying the voltage to the transfer roller such that a toner image on the photosensitive body is transferred onto the recording sheet upon application of the voltage to the transfer roller;

wherein the transfer unit has a fixed resistance (Rf) and variable resistance (Rs) coupled with the fixed resistance in series, and the first determination means includes:

means for applying a test voltage (Vtest) to the transfer unit;

means for measuring a voltage drop (Vo) across the fixed resistance (Rf); and means for determining the variable resistance value (Rs) using the following equation:

$$Rs=(Vtest/Vo-1)Rf.$$

5. The image recording device of claim 2, 3 or 4, wherein the second determination means includes:

a characteristic map providing first relationship between temperature and the first resistance value and second relationship between the temperature and the second resistance value;

means for determining the temperature from the first resistance value using the first relationship of the characteristic map; and means for determining the second resistance value from the temperature using the second relationship of the characteristic map.

6. An image recording device for recording an image on a recording sheet, comprising:

a transfer unit having a transfer roller and opposed photosensitive body such that the recording sheet is nipped between the transfer roller and photosensitive body;

first determination means for determining a first resistance value of the transfer unit when no recording sheet is nipped between the transfer roller and photosensitive body;

second determination means for determining a second resistance value of the transfer unit of during recording sheet nipping based on the first resistance value;

third determination means for determining a voltage to be applied to the transfer unit based on the second resistance value; and means for applying the voltage to the transfer roller such that a toner image on the photosensitive body is transferred onto the recording sheet upon application of the voltage to the transfer roller;

wherein said image recording device further includes a temperature sensor for detecting a temperature of the transfer roller, and wherein the third determination means determines a voltage to be applied to the transfer unit based on the second resistance value and the detected temperature.

7. The image recording device of claim 6, wherein the transfer roller is made from a urethane foam.

8. A method of recording an image on a recording sheet using an image recording device, the image recording device including a transfer unit having a transfer roller and opposed photosensitive body such that the recording sheet is nipped between the transfer roller and photosensitive body, the image recording device being adapted to form a toner image on the photosensitive body, comprising the steps of:

A) determining a first resistance value of the transfer unit of when no recording sheet is nipped between the transfer roller and photosensitive body;

B) determining a second resistance value of the transfer unit of during recording sheet nipping based on the first resistance value;

C) determining a voltage to be applied to the transfer unit based on the second resistance value; and D) applying the voltage to the transfer roller such that the toner image on the photosensitive body is transferred onto the recording sheet upon application of the voltage to the transfer roller;

wherein the transfer unit has a fixed resistance (Rf) and variable resistance (Rs) coupled with the fixed resistance in series, and the step A is carried out by the substeps of:

applying a test voltage (Vtest) to the transfer unit;

measuring a voltage drop (Vo) across the fixed resistance (Rf);

measuring a current (I) flowing in the transfer unit; and determining the variable resistance value (Rs) using the following equation:

$$RS=(Vtest-Vo)/I.$$

9. A method of recording an image on a recording sheet using an image recording device, the image recording device including a transfer unit having a transfer roller and opposed photosensitive body such that the recording sheet is nipped between the transfer roller and photosensitive body, the image recording device being adapted to form a toner image on the photosensitive body, comprising the steps of:

A) determining a first resistance value of the transfer unit of when no recording sheet is nipped between the transfer roller and photosensitive body;

B) determining a second resistance value of the transfer unit of during recording sheet nipping based on the first resistance value;

C) determining a voltage to be applied to the transfer unit based on the second resistance value; and D) applying the voltage to the transfer roller such that the toner image on the photosensitive body is transferred onto the recording sheet upon application of the voltage to the transfer roller;

wherein the transfer unit has a fixed resistance (Rf) and variable resistance (Rs) coupled with the fixed resistance in series, and the step A is carried out by the substeps of:

applying a test voltage (Vtest) to the transfer unit;

measuring a voltage drop (Vo) across the fixed resistance (Rf); and determining the variable resistance value (Rs) using the following equation:

$$Rs=(Vtest-Vo)Rf/Vo.$$

10. A method of recording an image on a recording sheet using an image recording device, the image recording device including a transfer unit having a transfer roller and opposed photosensitive body such that the recording sheet is nipped between the transfer roller and photosensitive body, the image recording device being adapted to form a toner image on the photosensitive body, comprising the steps of:

A) determining a first resistance value of the transfer unit of when no recording sheet is nipped between the transfer roller and photosensitive body;

B) determining a second resistance value of the transfer unit of during recording sheet nipping based on the first resistance value;

C) determining a voltage to be applied to the transfer unit based on the second resistance value; and D) applying the voltage to the transfer roller such that the toner image on the photosensitive body is transferred onto the recording sheet upon application of the voltage to the transfer roller;

wherein the transfer unit has a fixed resistance (Rf) and variable resistance (Rs) coupled with the fixed resistance in series, and the step A is carried out by the substeps of:

applying a test voltage (Vtest) to the transfer unit;

measuring a voltage drop (Vo) across the fixed resistance (Rf); and determining the variable resistance value (Rs) using the following equation:

$$Rs=(Vtest/Vo-1)Rf.$$

11. The method recited in any one of claims 8, 9 or 10, wherein the step B is carried out by the substeps of:

providing a characteristic map establishing first relationship between temperature and the first resistance value and second relationship between the temperature and the second resistance value;

determining the temperature from the first resistance value using the first relationship of the characteristic map; and determining the second resistance value from the temperature using the second relationship of the characteristic map.

12. A method of recording an image on a recording sheet using an image recording device, the image recording device including a transfer unit having a transfer roller and opposed photosensitive body such that the recording sheet be nipped between the transfer roller and photosensitive body, the image recording device being adapted to form a toner image on the photosensitive body, comprising the steps of:

A) determining a first resistance value of the transfer unit of when no recording sheet is nipped between the transfer roller and photosensitive body;

B) determining a second resistance value of the transfer unit of during recording sheet nipping based on the first resistance value;

C) measuring a temperature of the transfer roller;

D) determining a voltage to be applied to the transfer unit based on the second resistance value and the transfer roller temperature; and E) applying the voltage to the transfer roller such that the toner image on the photosensitive body is transferred onto the recording sheet upon application of the voltage to the transfer roller.

* * * * *